US005520557A

United States Patent [19]

Kaul et al.

[11] Patent Number: 5,520,557

[45] Date of Patent: May 28, 1996

[54] HYDROJET

[75] Inventors: Stefan Kaul, Harschbach; Stefan Huth, Boppard, both of Germany

[73] Assignee: Schottel-Werft, Josef Becker GmbH & Co. KG, Germany

[21] Appl. No.: 199,063

[22] Filed: Feb. 22, 1994

[30] Foreign Application Priority Data

Feb. 20, 1993 [DE] Germany ..... 43 05 267.3

[51] Int. Cl.[6] ..... B63H 11/00

[52] U.S. Cl. ..... 440/38; 114/151

[58] Field of Search ..... 440/38, 40, 42; 114/151

[56] References Cited

U.S. PATENT DOCUMENTS

| | | | |
|---|---|---|---|
| 4,459,117 | 7/1984 | Jordan | 440/38 |
| 5,146,865 | 9/1992 | Lais et al. | 114/151 |

FOREIGN PATENT DOCUMENTS

| | | | |
|---|---|---|---|
| 16979 | 9/1927 | Netherlands | 440/38 |
| 1689214 | 11/1991 | U.S.S.R. | 440/38 |

*Primary Examiner*—Jesus D. Sotelo
*Attorney, Agent, or Firm*—Levine & Mandelbaum

[57] ABSTRACT

A hydrojet for ships, intended for use in shallow waters, has a semiaxially bladed impeller with a vertical axis of rotation rotatably arranged in a well-shaped housing. The drive for the impeller is introduced into the housing from the top through a cover plate, and the housing is closed at the bottom by a bottom plate which has a water inlet arranged in the center for axial admission to the impeller and at least one flatly sloped water outlet. A control device in which the water delivered by the impeller is fed to at least one outlet nozzle without conversion of kinetic energy into pressure energy, is arranged between the discharge end of the delivery channels of the impeller and at least one water outlet. The control device forms a ring channel without blading. The water inlet is designed asymmetrically. The bottom plate with the water inlet and the water outlet of which there is at least one, which water inlet and water outlet are integrated in it, is endlessly rotatable around the longitudinal axis of the housing in both circumferential directions, either as part of the housing, which is rotatable as a whole, or in relation to the housing, which may be part of the carrying ship design in the latter case.

6 Claims, 2 Drawing Sheets

HYDROJET

BACKGROUND OF THE INVENTION

The present invention pertains to a hydrojet.

The control device in so-called "pot pumps" is a stationary blade ring, in which the blades are arranged such that kinetic energy is converted in the control device into pressure energy to the greatest extent possible. The drive device, which is preferably arranged behind the plane of the flat ship bottom, draws in water from the area under the ship bottom, and the water drawn in is accelerated in the impeller, so that at the outlet of the impeller it has a high kinetic energy, which is converted into pressure 10 energy at the outlet of the control device. That is, the water has a high pressure energy after being discharged from the control device and in the pressure housing. Because of this high pressure energy, it is able to leave the pressure housing at any desired point of the pressure housing and to enter outlet nozzles which determine the direction of outlet of the water jet bringing about the propulsion of the ship. The advantage of this solution is the free selection of the arrangement of the outlet nozzles. The disadvantage is that the design is a relatively expensive one (see DE-A-4021340).

SUMMARY OF THE INVENTION

The task of the present invention is to design a drive device of this class which will have a simpler design and a lighter weight than the prior-art solution.

The task is accomplished by providing a hydrojet wherein a semiaxially bladed impeller with a vertical axis of rotation is rotatably arranged in a well-shaped pump housing, into which the drive for the impeller is introduced from the top through a cover plate, which pump housing is closed at the bottom by a bottom plate, which has a water inlet arranged in the center for axial admission to the impeller and at least one flatly sloped water outlet, wherein a control device is arranged between the discharge end of the delivery channels of the impeller and at least one of the water outlets, the control device having a bladeless ring channel arranged concentrically to the axis of the impeller between the pump housing and the impeller housing in which ring channel the flow is brought from the semiaxial direction on leaving the impeller into a discharge flow, which forms an angle between 160° and 200° with the direction of admission.

The hydrojet according to the present invention is schematically represented in the drawings and will be explained below. In the drawings,

DESCRIPTION OF THE PREFERRED EMBODIMENT

Figure 1:
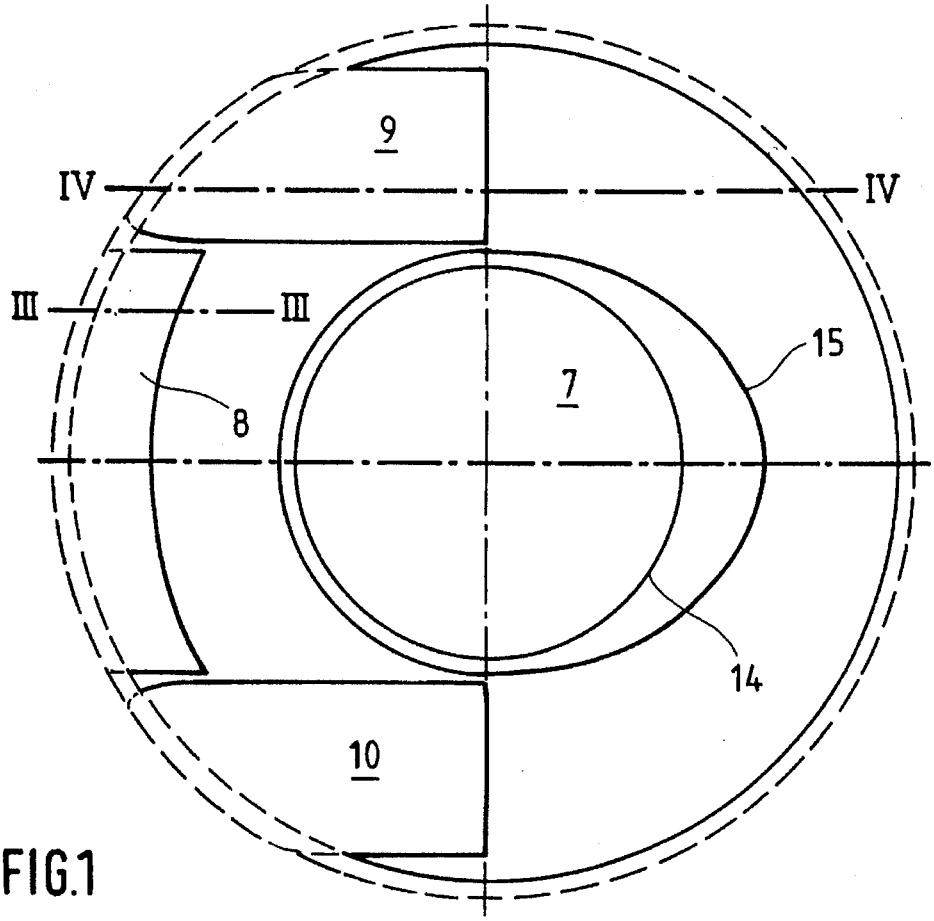
FIG. 1 is a view of the lower cover plate of the drive.

The essential subassemblies of the hydrojet according to the present invention are the pot-shaped pump housing 1, the pump impeller 3 forming semiaxially extending blade or flow channels between its blades 2, the drive 4 of the impeller, the control device 5, and a lower cover plate 6, within which the water inlet 7, a central outlet nozzle 8, and two lateral outlet nozzles 9, 10 are integrated in the center. "Semiaxially bladed" means that the flow is admitted axially to the impeller 3, and the water, provided with kinetic energy, leaves the impeller and enters the control device at an angle that is smaller than 90° in relation to the axis of rotation of the impeller. The drive 4 may be a conventional drive, so that it is not necessary to describe it. It is attached to a cover of the pump housing 1 and extends into the pump housing to be nonrotatably connected to the impeller 3 there. It may be the same as, e.g., the drive provided in DE-A-4021340. A relatively wide-meshed inlet grate 11 may be arranged in the inlet 7; the inlet grate 11 may be relatively wide-meshed because, due to the absence of a bladed control device, the drive is more insensitive to foreign particles carried in the water than a drive with a bladed control device.

According to the present invention, the control device is an unbladed ring diffusor with a discharge angle between about 160° and 200° and preferably 180° in relation to the axis of the impeller. The control device 5 is formed by the housing outer wall 12 directly on the outside and by the impeller housing 13 on the inside. It is rotationally symmetrical and has no built-in parts. It guarantees long guidance to the outlet nozzles 8, 9 and 10.

The inlet is asymmetric with an end circle 14 and with another end circle 15 offset in relation to the first one. The asymmetric suction geometry is designed such that a low-cavitation inlet is guaranteed under the most frequently occurring operating conditions.

The design according to the present invention avoids inlet losses and guarantees low discharge losses in the diffusor; friction occurs only on the diffusor walls rather than at the blade walls. The long flow in the diffusor, directed toward the outlet nozzles 8 through 10, makes it possible to accurately maintain a desired flow pattern. The ring diffusor design with both radial and axial direction of action leads to a relatively small housing or well internal diameter. This in turn makes possible a compact design at high thrust yield. This also leads to relatively large flow cross sections, which also leads to a high thrust yield at constant housing or well diameter (in relation to the prior-art solutions with bladed control device), as well as to a low tendency to cavitation and low risk of soiling, albeit it requires a relatively wide-meshed suction grate. The asymmetric inlet leads to a weak tendency to inlet cavitation, at least under the most frequently occurring operating conditions. The rotationally symmetrical diffusor without blades, and the formation of the diffusor directly by the housing wall and impeller housing mean a relatively low manufacturing cost and lead to a low weight which is especially important in the case of large drives.

The cross-sectional shape in the diffusor can be optimized, and the radii of deflection are to be determined such that a separation-free flow through the diffusor is guaranteed despite the missing guide blades.

The entire hydrojet is unlimitedly or endlessly rotatable, in known manner, around the longitudinal axis of the impeller 7 in both circumferential directions in order to make it possible to determine the direction of discharge of the water jets and consequently the direction of propulsion of the driven watercraft. For the same purpose, the bottom plate 6 with the nozzles 8 through 10, and with the inlet 7, may be rotatable in a corresponding manner in relation to the housing 1 which may be integrated as a jointly carrying assembly unit in the carrying ship design.

Figure 3:
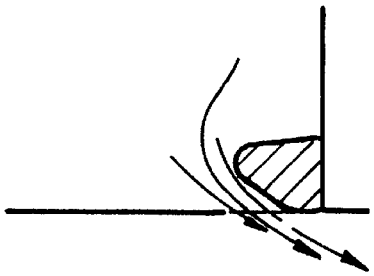
FIG. 3 is a view of a section taken along line III—III in FIGS. 1 and 2, and FIG. 4 a view of a section taken along IV—IV in FIG. 1.
Figure 4:
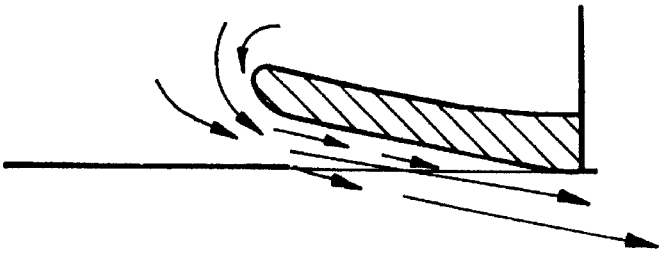
Figure 2:
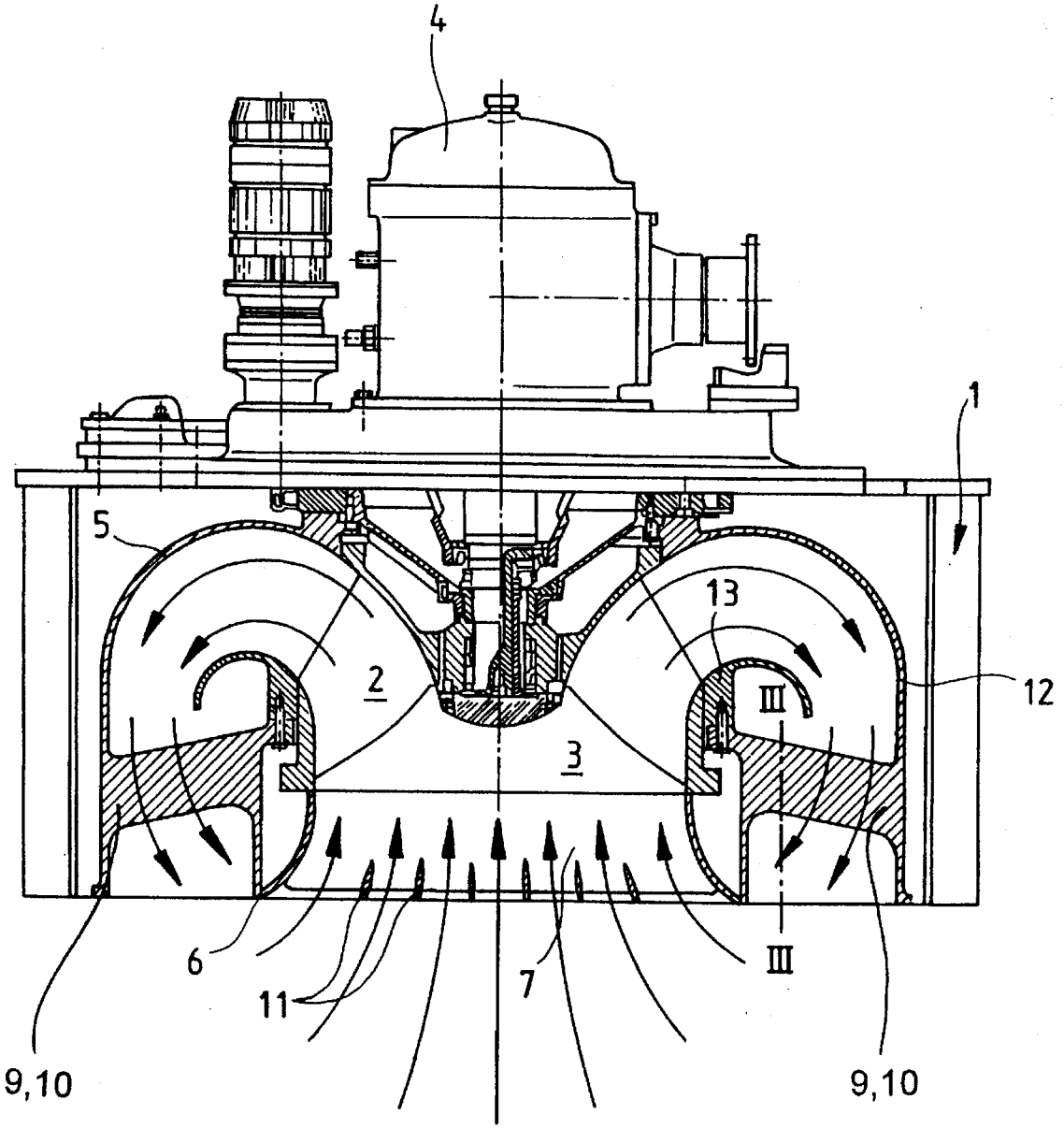
FIG. 2 is a view of a central longitudinal section through the drive.

The outlet nozzles 8 through 10 always guarantee that the water jets will leave the drive at a flat angle, as can be seen especially in FIGS. 3 and 4. It is consequently essential in the present invention for the control device to be an unbladed ring diffusor with an outlet angle of between 160° and 200°, and preferably 180°, in relation to the axis of the impeller.

The prior-art propulsion unit (DE-A-4021340) is relatively heavy due to the blade ring formed by the guide blades. This is especially disadvantageous in the case of propulsion units having large diameters, i.e., high-output propulsion units. It is characteristic that the control device with the guide blade ring acts exclusively in the radial direction. The blade channels must, therefore, have a great length. This results in the propulsion unit having a relatively large diameter, and, hence being relatively heavy, so as to be likely to cause installation problems. The substantial amount of space required by the propulsion unit detracts from the otherwise available useful space.

Due to the elimination of the blades, the ring diffusor according to the present invention is considerably lighter than the state of the art (DE-A-4021340) allows with a bladed control device. This distinction is especially important in the case of large units.

The ring diffusor, which is bladeless according to the present invention, is designed such that the direction of action is not only radial, but also axial. This means that the housing is smaller and lighter compared with that of a propulsion unit having a bladed control device, at equal thrust yield, or a higher thrust is achieved by the present invention with a device having equal outer dimensions and less weight than a corresponding prior art device. The latter version leads to a reduction in the risk of cavitation and in the tendency to soiling due to the now increased flow cross sections.

Due to the fact that the ring diffusor or control device 5 is formed directly by the housing outer wall 12 on the outside and by the impeller housing 13 on the inside, no separate components are needed for its construction. This makes it possible to obtain an efficient, low-weight hydrojet of a compact, simple design. A hydrojet according to the present invention guarantees a long guide to the outlet nozzles 8, 9 and 10. The cross-sectional shape of the control device can increase so that a further conversion of kinetic energy into pressure energy is achieved. However, the cross section is preferably constant or even decreasing, so that the kinetic energy of the flow can be directly utilized.

The twist component, i.e., the component pointing in the circumferential direction, of the flow leaving the impeller, is preserved more extensively in the unbladed control device than is possible in a bladed control device according to the state of the art.

It is to be appreciated that the foregoing is a description of a preferred embodiment of the invention to which variations and modifications may be made without departing from the spirit and scope of the invention.

What is claimed is:

1. A hydrojet for a ship intended to be used in shallow water, comprising a pump housing having a cylindrical wall circumscribing an axis vertical with respect to the ship, a cover plate mounted on top of the housing, a bottom plate mounted beneath the housing, said bottom plate having an inlet opening through which water can enter and at least one outlet opening for the discharge of the water, an impeller housing mounted in said pump housing and defining a chamber in communication with said inlet opening, an impeller mounted for rotation about an axis within said impeller housing to draw water upwardly through the inlet opening in the bottom plate, and a control means mounted between the inlet opening and outlet opening, the control means comprising a bladeless ring diffusor having a discharge angle in the range of 160° to 200° relative to said impeller axis.

2. A hydrojet according to claim 1 wherein the ring diffusor has an inner wall coextensive with said impeller housing.

3. A hydrojet according to claim 1 wherein the discharge angle is 180°.

4. A hydrojet according to claim 1 further comprising means for mounting the pump housing for rotation about the vertical axis relative to the ship, the bottom plate being fixedly mounted on the pump housing for rotation therewith, whereby the ship may be steering by rotating the pump housing.

5. A hydrojet according to claim 1 wherein the bottom plate is rotatably mounted with respect to the pump housing and further comprising means for fixedly mounting the pump housing on the ship, whereby the ship may be steering by rotating the bottom plate.

6. A hydrojet according to claim 1 wherein said control means has a plurality of outlet openings downstream of said impeller for discharging the water.

* * * * *